US012345507B1

(12) United States Patent
Massarello et al.

(10) Patent No.: US 12,345,507 B1
(45) Date of Patent: Jul. 1, 2025

(54) SYSTEM, APPARATUS, AND METHOD FOR A MOVABLE BALLISTIC BARRIER

(71) Applicant: Armourer's Choice, LLC, Ottawa (CA)

(72) Inventors: Jack Massarello, Novi, MI (US); Michael Ott, Lakewood, CO (US); James Larsen, Pahrump, NV (US)

(73) Assignee: Armourer's Choice, LLC, Ottawa (CA)

( * ) Notice: Subject to any disclaimer, the term of this patent is extended or adjusted under 35 U.S.C. 154(b) by 0 days.

(21) Appl. No.: 18/738,512

(22) Filed: Jun. 10, 2024

(51) Int. Cl.
*F41H 5/14* (2006.01)
*F41H 5/08* (2006.01)

(52) U.S. Cl.
CPC ..... *F41H 5/14* (2013.01); *F41H 5/08* (2013.01)

(58) Field of Classification Search
CPC ..... F41H 5/14; F41H 5/08; F41H 1/00
See application file for complete search history.

(56) References Cited

U.S. PATENT DOCUMENTS

| | | | | |
|---|---|---|---|---|
| 10,267,601 | B1 * | 4/2019 | Beck | F41H 5/14 |
| 2020/0025525 | A1 * | 1/2020 | Spransy | F41H 5/08 |
| 2024/0017394 | A1 * | 1/2024 | Kennedy, II | F41H 5/14 |
| 2024/0410676 | A1 * | 12/2024 | Matthews | F41H 5/08 |

* cited by examiner

*Primary Examiner* — J. Woodrow Eldred
(74) *Attorney, Agent, or Firm* — Keefe IP Law, PLLC

(57) ABSTRACT

An apparatus for supporting a first ballistic shield and a second ballistic shield is disclosed. The apparatus has a structural frame, and a wheel assembly rotatably attached to a structural connector of a base assembly of the structural frame. The structural frame is configured to removably attach to the first ballistic shield. The structural frame is configured to removably attach to the second ballistic shield. The wheel assembly includes a plurality of axles spaced away from the structural connector and configured to rotate about the structural connector when the wheel assembly rotates.

20 Claims, 9 Drawing Sheets

SYSTEM, APPARATUS, AND METHOD FOR A MOVABLE BALLISTIC BARRIER

TECHNICAL FIELD

The present disclosure generally relates to a system, apparatus, and method for a movable barrier, and more particularly to a system, apparatus, and method for a movable ballistic barrier.

BACKGROUND

Conventional systems for movable ballistic barriers are typically heavy and cumbersome. Typically, these conventional systems are too heavy and difficult to manage for one user to effectively maneuver and utilize. Even multiple users may struggle with maneuvering conventional systems in addition to their equipment and handling their weapons. Accordingly, these conventional systems are typically movable by multiple users or crews of users, often with difficulty, as opposed to a single user.

It is often difficult to maneuver conventional systems over uneven surfaces and difficult terrain, even with multiple users handling the system. For example, it is typically difficult to move conventional systems up stairs due to their weight and bulky size.

Some conventional systems attempt to improve maneuverability by reducing a weight of that system. However, such reductions in weight typically equate to a decrease in armor effectiveness. For example, these lighter-weight, conventional systems typically experience degradation in body armor class type and effectiveness against a range of firearms and ballistic projectiles.

The exemplary disclosed system, apparatus, and method of the present disclosure are directed to overcoming one or more of the shortcomings set forth above and/or other deficiencies in existing technology.

SUMMARY OF THE DISCLOSURE

In one exemplary aspect, the present disclosure is directed to an apparatus for supporting a first ballistic shield and a second ballistic shield. The apparatus includes a structural frame, and a wheel assembly rotatably attached to a structural connector of a base assembly of the structural frame. The structural frame is configured to removably attach to the first ballistic shield. The structural frame is configured to removably attach to the second ballistic shield. The wheel assembly includes a plurality of axles spaced away from the structural connector and configured to rotate about the structural connector when the wheel assembly rotates.

In another aspect, the present disclosure is directed to a method. The method includes providing a structural frame having a wheel assembly rotatably attached to a structural connector of a base assembly of the structural frame, the wheel assembly including a plurality of axles spaced away from the structural connector, removably attaching a first ballistic shield to the structural frame, removably attaching a second ballistic shield to the structural frame, and moving the structural frame and rotating the plurality of axles about the structural connector as the wheel assembly rotates along an uneven surface, each of the plurality of axles including at least one wheel

DETAILED DESCRIPTION AND INDUSTRIAL APPLICABILITY

Figure 1:
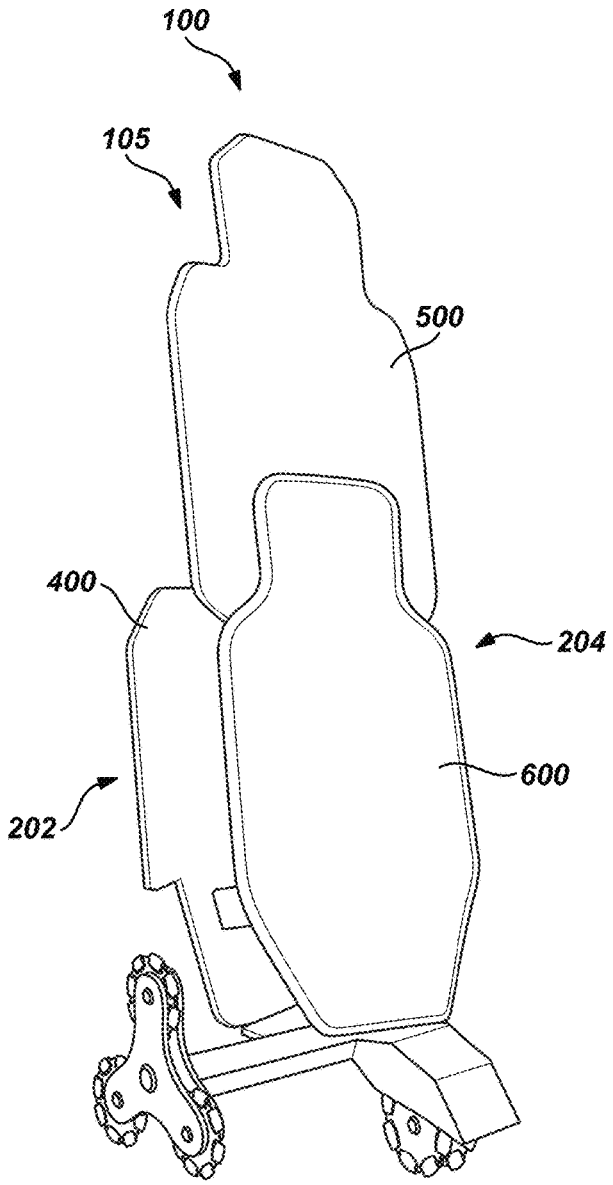
FIG. 1 is a perspective view of an exemplary embodiment of the present invention.
Figure 2:
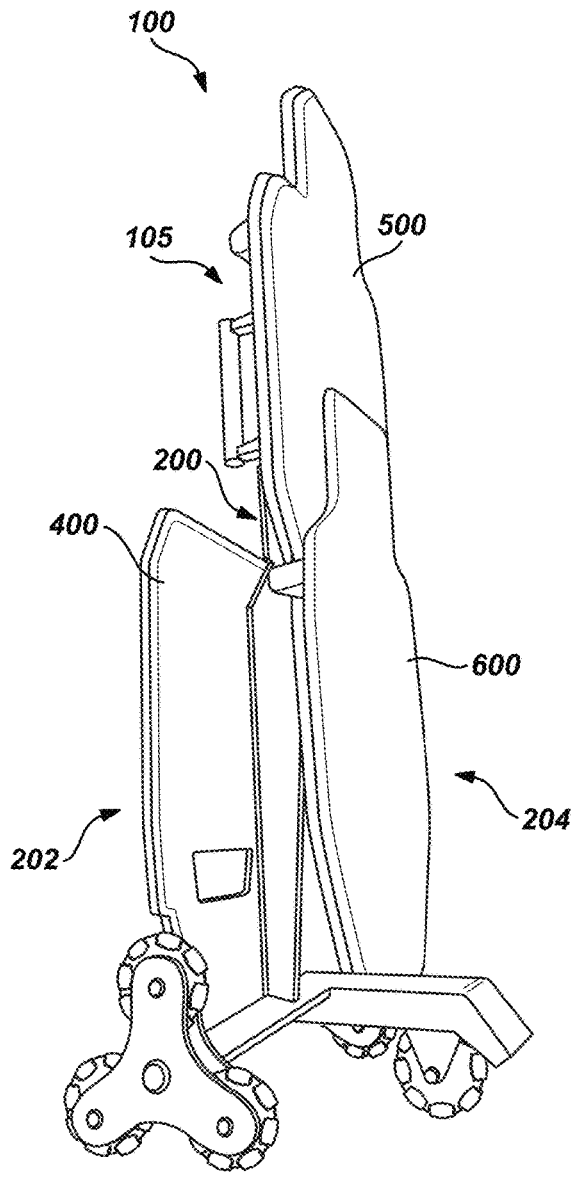
FIG. 2 is another perspective view of the exemplary embodiment illustrated in FIG. 1.

The exemplary disclosed system, apparatus, and method may provide a movable barrier (e.g., a movable ballistic shield or barrier) that may be relatively light and easily movable by a single individual or a plurality of individuals (e.g., crew-served). FIGS. 1 and 2 illustrate an exemplary disclosed system 100 that may include a barrier apparatus 105. Barrier apparatus 105 may be a movable shield (e.g., a movable fighting post). Barrier apparatus 105 may include a structural frame 200 that may support a first shield assembly 400, a second shield assembly 500, and/or a third shield assembly 600, each of which may be removably attachable to structural frame 200. First shield assembly 400, second shield assembly 500, and third shield assembly 600 may be ballistic shields (e.g., handheld ballistic shields).

Figure 3:
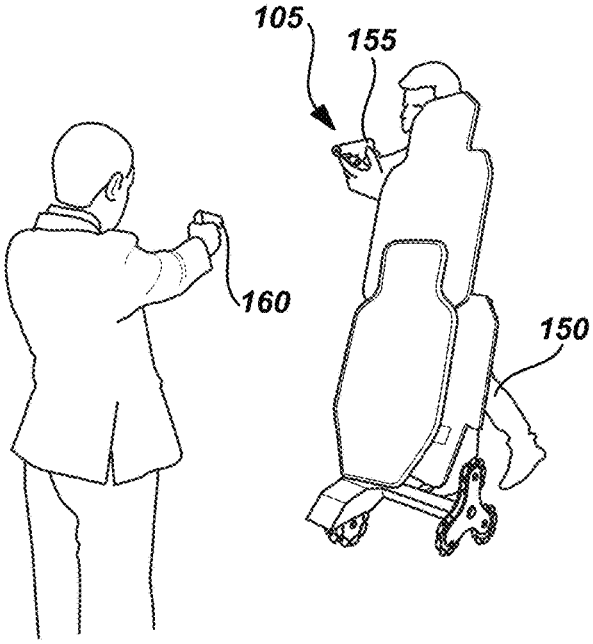
FIG. 3 is another perspective view of the exemplary embodiment illustrated in FIG. 1.
Figure 4:
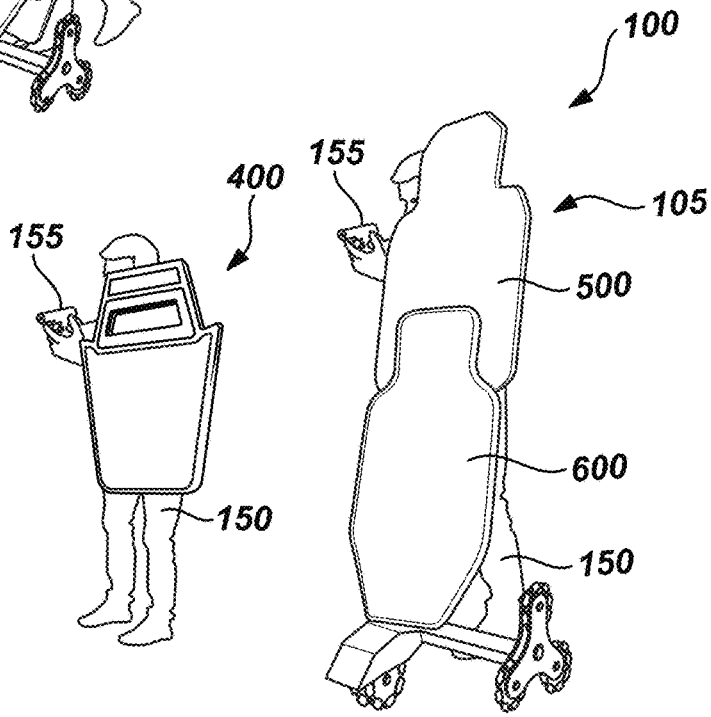
FIG. 4 is another perspective view of the exemplary embodiment illustrated in FIG. 1.
Figure 5:
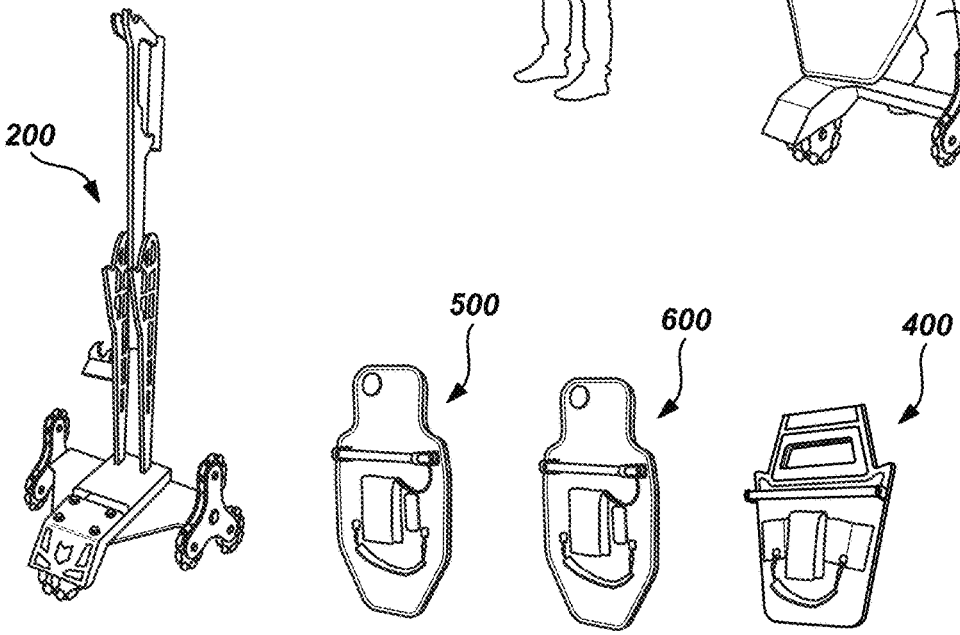
FIG. 5 is another perspective view of the exemplary embodiment illustrated in FIG. 1.

As illustrated in FIGS. 3 through 5, system 100 may be used by one or more users 150. For example, users 150 may use system 100 in conjunction with the use of one or more weapons 155 such as firearms. Users 150 may be law enforcement personnel, military personnel, security personnel, and/or any other users who may use weapons 155. Weapon 155 may be a firearm such as, for example, a rifle, a handgun, a machine gun, or any other suitable weapon for launching a projectile such as a bullet or non-lethal alternatives. Weapon 155 may also be a larger weapon such as a vehicle-mounted weapon (e.g., mounted to a ground, air, or sea vehicle) and/or any other weapon that may be fired at a target such as users 150. Users 150 may be protected by system 100 from one or more threat weapons 160 fired by hostile persons at users 150 and barrier apparatus 105. Threat weapons 160 may be generally similar to weapons 155. As further described below, system 100 may be a modular system including a plurality of shield assemblies (e.g., shield assemblies 400, 500, and 600) that may be removably attached and detached from structural frame 200 as suitable for a given mission or encounter. For example as illustrated in FIG. 4, one or more shields (e.g., first shield assembly 400) may be detached from structural frame 200 and used as a personal shield by a given user 150, while other shields (e.g., second shield assembly 500 and third shield assembly 600) may remain attached to structural frame 200 to protect one or more other users 150. Further for example, some or all shields (e.g., shield assemblies 400, 500, and/or 600) of barrier apparatus 105 may be removed from structural frame 200 and used by various users 150 away from structural frame 200. The plurality of exemplary disclosed shield assemblies may thereby be used in various desired combinations to protect one or more users 150. Structural frame 200 (e.g., with all, some, or no exemplary disclosed shield assemblies) may be maneuvered (e.g., moved or rolled) by one or more users 150 during use of system 100.

Figure 6:
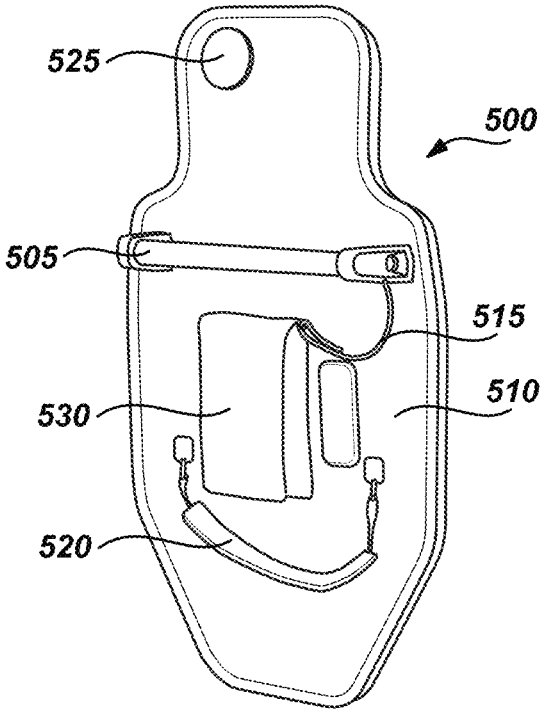
FIG. 6 is a perspective view of an exemplary component of the present invention.
Figure 7:
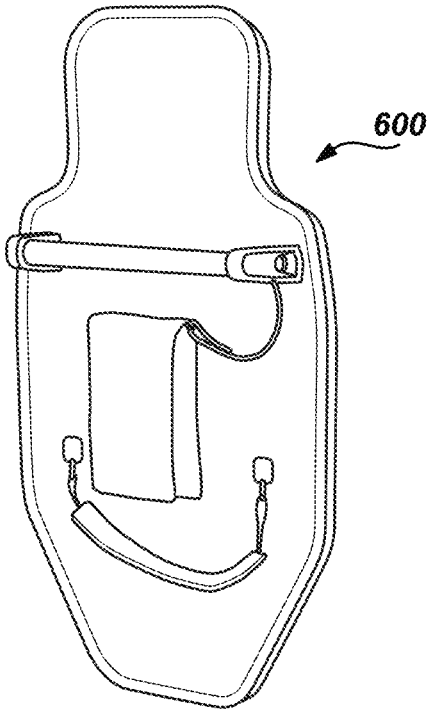
FIG. 7 is a perspective view of an exemplary component of the present invention.
Figure 8:
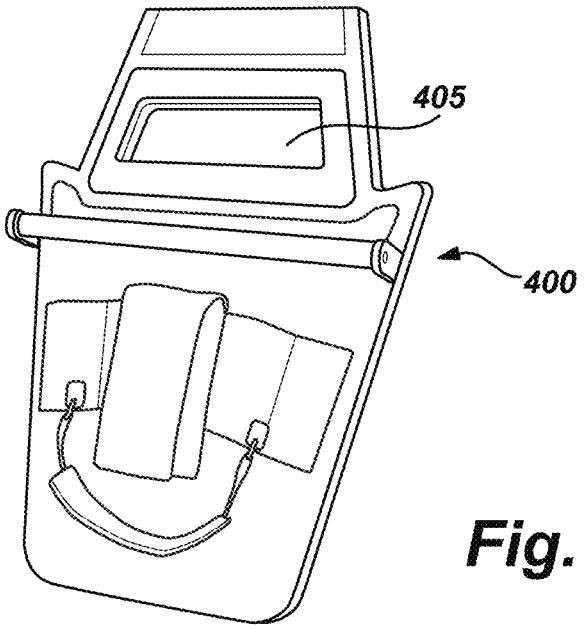
FIG. 8 is a perspective view of an exemplary component of the present invention.

FIG. 6 illustrates an exemplary embodiment of the exemplary disclosed shields. Second shield assembly 500 may be any suitable ballistic shield (e.g., handheld ballistic shield). Second shield assembly 500 may be formed from any suitable material for protecting user 150 from projectiles (e.g., fired from threat weapon 160) such as any suitable structural material. Second shield assembly 500 may be formed from metal material, ceramic material, aramid material, polyethylene material (e.g., variations of polyethylene material), composite material, and/or any other suitable structural material. For example, second shield assembly 500 may be formed from ultra-high molecular weight polyethylene (UHMWPE) material. In at least some exemplary embodiments, second shield assembly 500 may be formed from a combination of ceramic, UHMWPE, and/or other composite material configurations. Second shield assembly 500 may be formed from a single layer of the exemplary disclosed structural material or from multiple layers of the same material or from multiple layers of varying exemplary disclosed material.

Second shield assembly 500 may have any suitable shape for providing a shield for user 150 against one or more threat weapons 160. For example, second shield assembly 500 may have a rectangular shape, square shape, polygonal shape, elliptical shape, circular shape, or any other suitable shape. Second shield assembly 500 may include a shield handle 505 (e.g., a handle bar) for user 150 to hold second shield assembly 500. For example, shield handle 505 may allow user 150 to hold second shield assembly 500 (e.g., to hold second shield assembly 500 with one hand or arm while holding weapon 155 with the other hand or arm) and/or as a step for viewing over barriers or scaling obstacles. Second shield assembly 500 may be used to help support weapon 155 of user 150. Second shield assembly 500 may thereby serve as a handheld ballistic shield. Second shield assembly 500 may include an attachment layer 510 that may cover some or substantially all of one side (e.g., or both sides) of second shield assembly 500. For example, attachment layer 510 may include either a hook or a loop portion of a hook and loop fastener (e.g., Velcro®), a surface suitable for removably adhering items, clips, magnetic attachment components, tape, and/or any other suitable attachment layer or fastener. Any other suitable fasteners, devices, and/or items may be disposed at second shield assembly such as, for example, a lanyard 515, a strap 520, a reflective device 525 (e.g., a mirror such as a rearview mirror), a storage device 530 (e.g., a physical storage device such as a container, pouch, or an electrical storage device such as a battery), and/or any other desired item (e.g., for use by user 150). Lanyard 515, strap 520, reflective device 525, storage device 530, and/or any other desired item may be removably attachable to attachment layer 510 and/or to any other suitable portion of second shield assembly 500. In at least some exemplary embodiments, second shield assembly 500 may have a National Institute of Justice (NIJ) Level IV body armor rating (or any other suitable armor rating such as, for example, Level IIIA, or Level III). Second shield assembly 500 may have any suitable dimensions such as, for example, a height of between about 2 feet and about 6 feet (e.g., or more or less), and a width of between about 2 feet and about 4 feet (e.g., or more or less). Second shield assembly 500 may have any suitable weight such as, for example, between about 10 lbs and about 30 lbs, or any other suitable weight.

Third shield assembly 600 may be generally similar to second shield assembly 500 described above. In at least some exemplary embodiments, second shield assembly 500 and third shield assembly 600 may be formed from similar material, and have a similar shape, dimensions, and/or weight.

First shield assembly 400 may be generally similar to second shield assembly 500 described above. In at least some exemplary embodiments, first shield assembly 400 may have a smaller weight and smaller dimensions as second shield assembly 500. For example, first shield assembly 400 may weigh between about 5 lbs and about 26 lbs, or any other suitable weight. First shield assembly 400 may include one or more partially or substantially entirely transparent members 405 such as, for example, a ballistic-proof or ballistic-resistant member (e.g., formed from ballistic-proof or ballistic-resistant glass, polycarbonate, acrylic, laminated glass such as layers of laminated glass, polyurethane, and/or any other suitable materials). Second shield assembly 500 and third shield assembly 600 may also include one or more transparent members similar to transparent member 405. Alternatively in at least some exemplary embodiments, first shield assembly 400 and second shield assembly 500 may be formed from similar material, and have a similar shape, dimensions, and/or weight.

Returning to FIGS. 1 and 2, first shield assembly 400, second shield assembly 500, and third shield assembly 600 may be removably attachable to structural frame 200 and/or person-portable from structural frame 200 in any suitable configuration. For example, first shield assembly 400 may be removably attachable to a first side 202 (e.g., rear side) of structural frame 200, and second shield assembly 500 and/or third shield assembly 600 may be removably attachable to a second side 204 (e.g., front side) of structural frame 200. Alternatively for example, any of first shield assembly 400, second shield assembly 500, and third shield assembly 600 (e.g., and/or additional shields) may be removably attachable to first side 202 of structural frame 200, and others of first shield assembly 400, second shield assembly 500, and third shield assembly 600 (e.g., and/or additional shields) may be removably attachable to second side 204 of structural frame 200.

FIGS. 9 through 14 illustrate an exemplary embodiment of structural frame 200. Structural frame 200 may include a post assembly 205 and a base assembly 210. Post assembly 205 may be removably attachable to base assembly 210.

Figure 11:
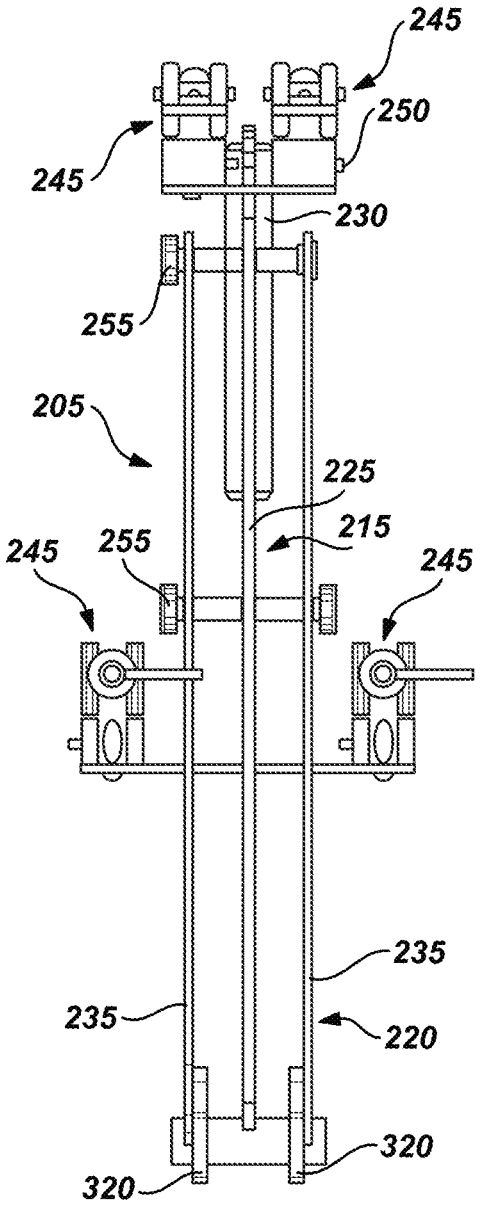
FIG. 11 is a front view of an exemplary component of the present invention.
Figure 12:
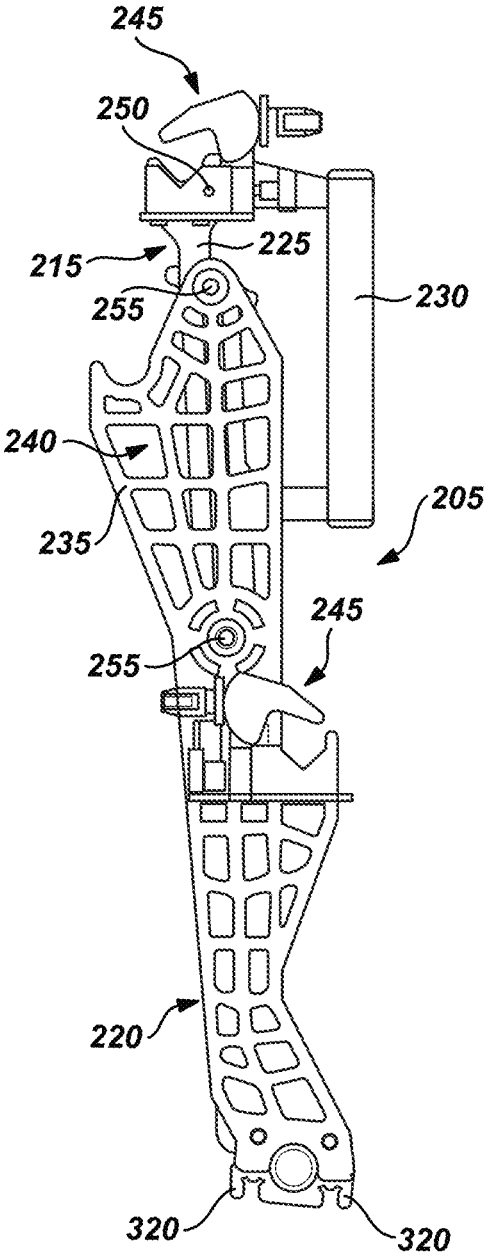
FIG. 12 is a side view of the exemplary component illustrated in FIG. 11.

Post assembly 205 may be formed from ferrous or non-ferrous metallic or composite material (e.g., and/or from material similar to the exemplary disclosed material described above regarding second shield assembly 500). Post assembly 205 may include an upper assembly 215 that may be movably attachable to a lower assembly 220. Upper assembly 215 may include a shaft member 225. In at least some exemplary embodiments, shaft member 225 may be a steel, titanium, or aluminum shaft. A post handle 230 such as a steel handle may be attached to (e.g., or integrated into) shaft member 225 via any suitable technique (e.g., welding, mechanical fasteners such as screws and/or bolts, and/or any other suitable attachment technique). For example as illustrated in FIGS. 11 and 12, lower assembly 220 may include one or more frame members 235 such as, for example, steel frame members. Frame member 235 may be formed from integrally formed and/or fixedly attached members such as struts and/or a structural plate including a plurality of apertures 240.

Upper assembly 215 and/or lower assembly 220 may include a plurality of shield holders 245. Shield holder 245 may be a clamp, fitting, coupling, and/or any other suitable fastener for removably attaching to the exemplary disclosed shield handles (e.g., shield handle 505). In at least some exemplary embodiments, shield holder 245 may include a removable fastener 250 (e.g., a pin or bolt) that may be removably inserted into shield holder 245 to maintain shield holder 245 fixed (e.g., clamped) around the exemplary disclosed shield handle and/or removed from shield holder 245 (e.g., to allow shield holder 245 to open so that the exemplary disclosed shield handle may be removed from shield holder 245). Shield holders 245 may be configured to removably receive and support the exemplary disclosed shield assemblies (e.g., first shield assembly 400, second shield assembly 500, and/or third shield assembly 600) in any suitable configuration or arrangement relative to structural frame 200, similar for example to as further described below regarding FIG. 15.

Figure 9:
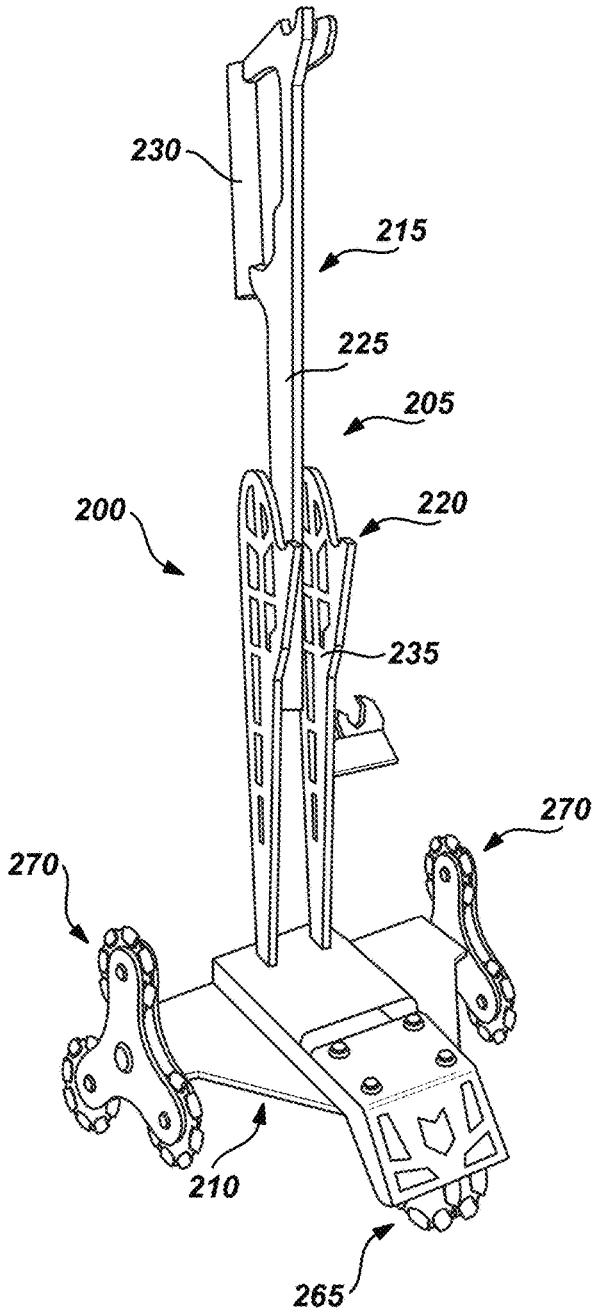
FIG. 9 is a perspective view of an exemplary component of the present invention.

Upper assembly 215 and lower assembly 220 may be movably attached to each other via one or more movable fasteners 255. Movable fastener 255 may be any suitable fastener for selectively fixing upper assembly 215 and lower assembly 220 at any suitable desired position relative to each other. Movable fastener 255 may be a rotatable (e.g., screw) clamp, a toggle clamp, and/or any other suitable fastener that may selectively allow and block a movement of upper assembly 215 and lower assembly 220 relative to each other. For example, movable fastener 255 may be tightened (e.g., by user 150) when upper assembly 215 is at an extended position relative to lower assembly 220 for example as illustrated in FIG. 9, and/or when upper assembly 215 is at a retracted position relative to lower assembly 220 (e.g., retracted into lower assembly 220) for example as illustrated in FIGS. 11 and 12 (e.g., or at any other desired position between the extended position and the retracted position). Movable fastener 250 may be loosened when a position of upper assembly 215 is desired to be moved relative to lower assembly 220. Post assembly 205 may thereby be selectively fixed at and movable between the extended position illustrated in FIG. 9 (e.g., during use of barrier apparatus 105) and the retracted position illustrated in FIGS. 11 and 12 (e.g., during storage, stowing, and/or transport of barrier apparatus 105). Post assembly 205 may thereby be collapsible to facilitate storage, stowing, and/or transport of barrier apparatus 105.

Figure 13:
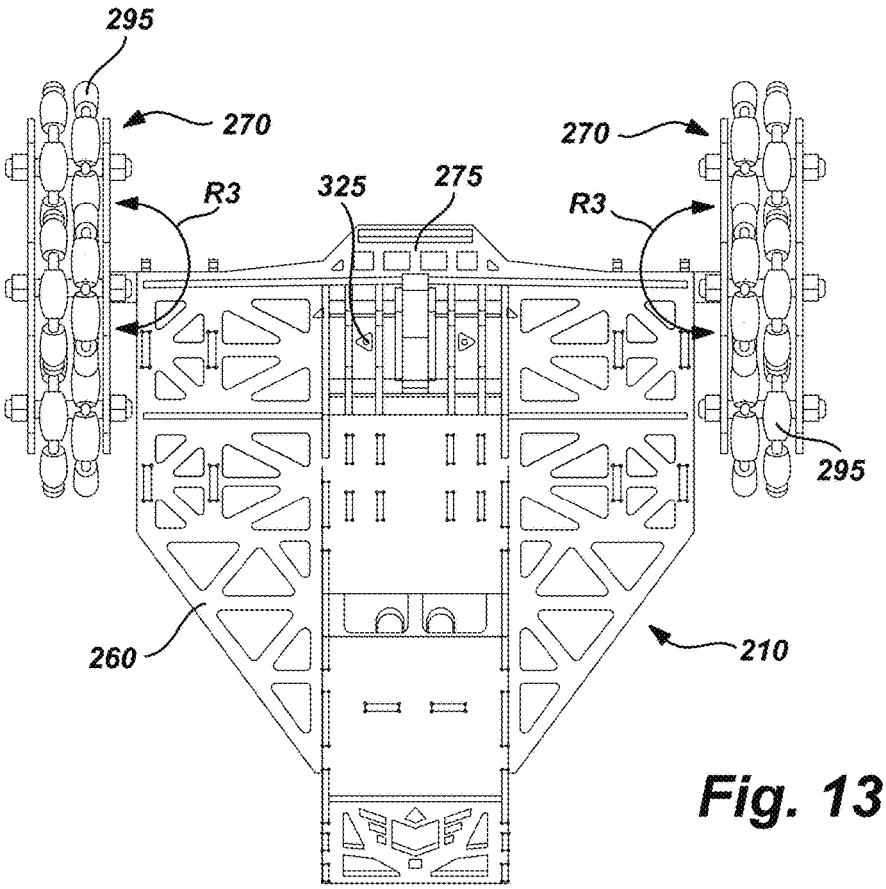
FIG. 13 is a top view of an exemplary component of the present invention.
Figure 14:
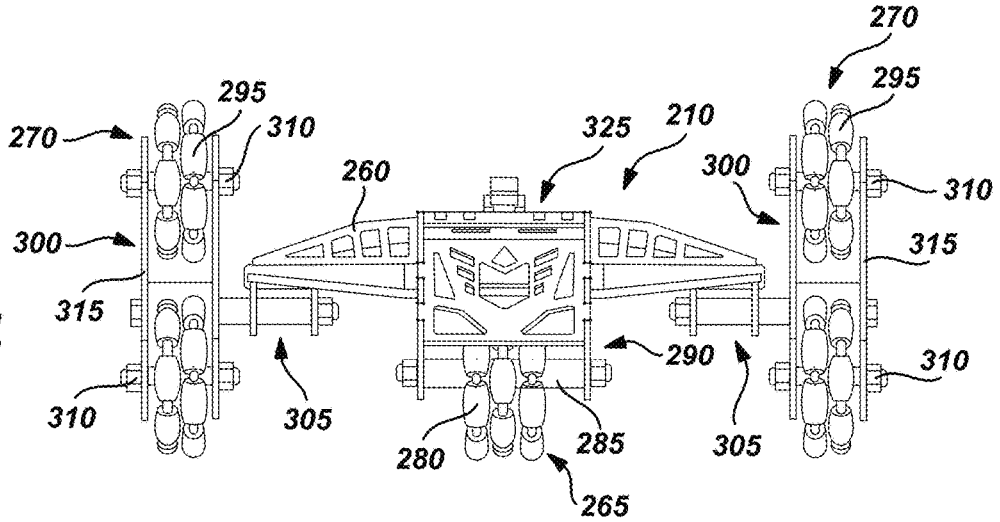
FIG. 14 is a front view of the exemplary component illustrated in FIG. 13.

As illustrated in FIGS. 13 and 14, base assembly 210 may include a base frame member 260 that may be formed similarly and/or from similar members and materials as frame member 235. One or more front wheel assemblies 265 and one or more side wheel assemblies 270 may be attached to base frame member 260 via any suitable attachment technique such as, for example, welding, mechanical fastening (e.g., via bolts), and/or any other suitable fastening technique.

One or more front wheel assemblies 265 may be attached under a portion of base frame member 260. Base frame member 260 may serve as a protective covering that may substantially prevent front wheel assembly 265 from being deformed or damaged during an operation of system 100. A kick plate 275 may be disposed at a rear portion (e.g., back portion) of base frame member 260 for example as illustrated in FIG. 13. Kick plate 275 may serve as a valance (e.g., front valance). Kick plate 275 may facilitate the negotiation of curbs, rocks, uneven terrain, and/or obstacles during a forward and/or reverse movement of barrier apparatus 105. Front wheel assembly 265 may include one or more front wheels 280 that may be rotatably supported on a front axle 285 (e.g., a member such as a shaft) that may be supported by a front structural connector 290 that may be attached to base frame member 260 via one or more exemplary disclosed attachment techniques described above. Front structural connector 290 may be formed from material similar to as described above regarding second shield assembly 500, and may be a bracket, a structural holder, or any other suitable structural connector.

Figure 10:
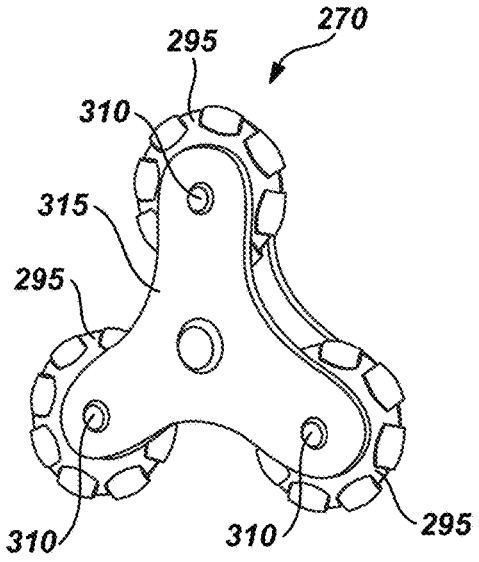
FIG. 10 is a detailed, perspective view of the exemplary component illustrated in FIG. 9.

One or more (e.g., a plurality of) side wheel assemblies 270 may be attached to side portions of base frame member 260. For example, two side wheel assemblies 270 may be attached to the sides of base frame member 260 (e.g., with a first side wheel assembly 270 disposed at an opposite side of base assembly 210 as a second side wheel assembly 270). Side wheel assembly 270 may include a plurality of side wheels 295 that may be rotatably supported by a side axle assembly 300 that may be supported by a side structural connector 305 (e.g., that may be generally similar to front structural connector 290) that may be attached to base frame member 260 via one or more exemplary disclosed attachment techniques described above. Side axle assembly 300 may include a plurality of side axles 310 (e.g., shafts) that may each rotatably support one or more side wheels 295. Side axles 310 may be attached to a side frame 315 that may be rotatably attached to side structural connector 305. Side frame 315 rotatably supporting side wheels 295 via side axles 310 may thereby rotate relative to base frame member 260 via side structural connector 305. In at least some exemplary embodiments and for example as illustrated in FIG. 10, three sets of one or more side wheels 295 may be supported by rotatable side frame 315 (e.g., or any other suitable number of sets such as two or four or more sets of side wheels 295 may also be supported by side frame 315). For example, side wheel assembly 270 may be rotatably attached to side structural connector 305 of base assembly 210 of structural frame 200. For example, side wheel assembly 270 may include a plurality of axles (e.g., side axles 310) spaced away from side structural connector 305 and configured to rotate about side structural connector 305 when side wheel assembly 270 rotates. For example, side wheel assembly 270 may include a plurality of axles (e.g., three axles such as side axles 310, or two or four or more axles) evenly spaced about side structural connector 305, each of the three axles including at least one side wheel 295.

Figure 10A:
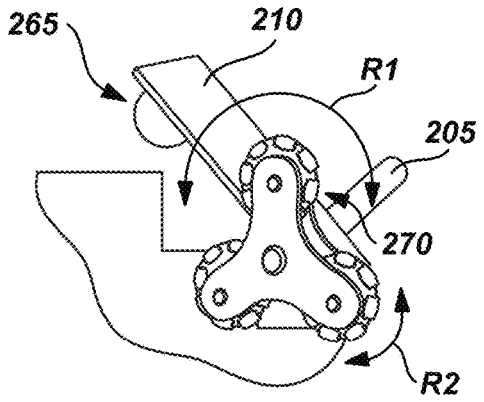
FIG. 10A is a schematic illustration of an exemplary operation of the exemplary component illustrated in FIGS. 10 and 10A.

As illustrated in FIG. 10A, the exemplary disclosed configuration may allow for barrier apparatus 105 to be rolled up or down inclined or declined structures and surfaces (e.g., stairs) and/or difficult and/or uneven terrain. For example, because side wheels 295 may be rotatable within side frame 315 and also side frame 315 may be rotatable relative to side structural connector 305, the entire side wheel assembly 270 may rotate relative to base frame member 260 while individual side wheels 295 may also rotate relative to side frame 315, which may facilitate movement of barrier apparatus 105 up and down stairs, uneven surfaces, and/or other difficult terrain. Also for example, barrier apparatus 105 may be rotated (e.g., based on user 150 pulling back on post handle 230 of post assembly 205) so that front wheel assembly 265 may be lifted off of a support surface (e.g., ground or terrain) as barrier apparatus 105 is moved (e.g., as illustrated in FIG. 10A). In at least some exemplary embodiments, side structural connectors 305 may also be rotatable relative to base frame member 260 so that side wheel assembly 270 may be rotatable left or right relative to a support surface (e.g., ground), which may further facilitate a relatively easy movement of barrier apparatus 105. Accordingly for example, each side wheel assembly 270 may be rotatable in a first rotation direction R1 as illustrated in FIG. 10A and also in a third rotation direction R3 as illustrated in FIG. 13, and each side wheel 295 may be rotatable in a second rotation direction R2 as illustrated in FIG. 10A. For example, side structural connector 305 may be rotatable in a direction (e.g., third rotation direction R3) that may be perpendicular (e.g., substantially perpendicular) to the rotation (e.g., rotation in the first rotation direction R1) of side wheel assembly 270.

Post assembly 205 may be removably attachable to base assembly 210 via any suitable attachment technique. For example as illustrated in FIGS. 11 through 14, one or more attachment protrusions 320 may be removably received in one or more corresponding attachment recesses 325 (e.g., forming a snap-fit connection, press-fit connection, and/or any other suitable connection). Also for example, mechanical fasteners or any other suitable connection technique (e.g., for example as described below) may be used to removably attach post assembly 205 to base assembly 210. Post assembly 205 may be removably attached to base assembly 210 for example when barrier apparatus 105 is in use, and post assembly 205 may be detached from base assembly 210 for example when barrier apparatus 105 is being transported, stowed, and/or stored.

Structural frame 200 may have any suitable dimensions (e.g., when in the exemplary disclosed extended position) such as, for example, a height of between about 4 feet and about 7 feet (e.g., or more or less), and a width of between about 2 feet and about 4 feet (e.g., or more or less). Structural frame 200 may have any suitable weight such as, for example, between about 20 lbs and about 50 lbs, between about 25 lbs and about 45 lbs, between about 30 lbs and about 40 lbs, between about 33 lbs and about 37 lbs, or any other suitable weight. Barrier apparatus 105 including structural frame 200, first shield assembly 400, second shield assembly 500, and third shield assembly 600 may have any suitable total weight such as, for example, between about 50 lbs and about 150 lbs, between about 80 lbs and about 130 lbs, between about 100 lbs and about 120 lbs, between about 105 lbs and about 115 lbs, or any other suitable weight.

In at least some exemplary embodiments, barrier apparatus 105 may be used as a medical apparatus. For example, structural frame 200 may be used as a tiltable one-man maneuverable gurney for medevac.

Figure 15:
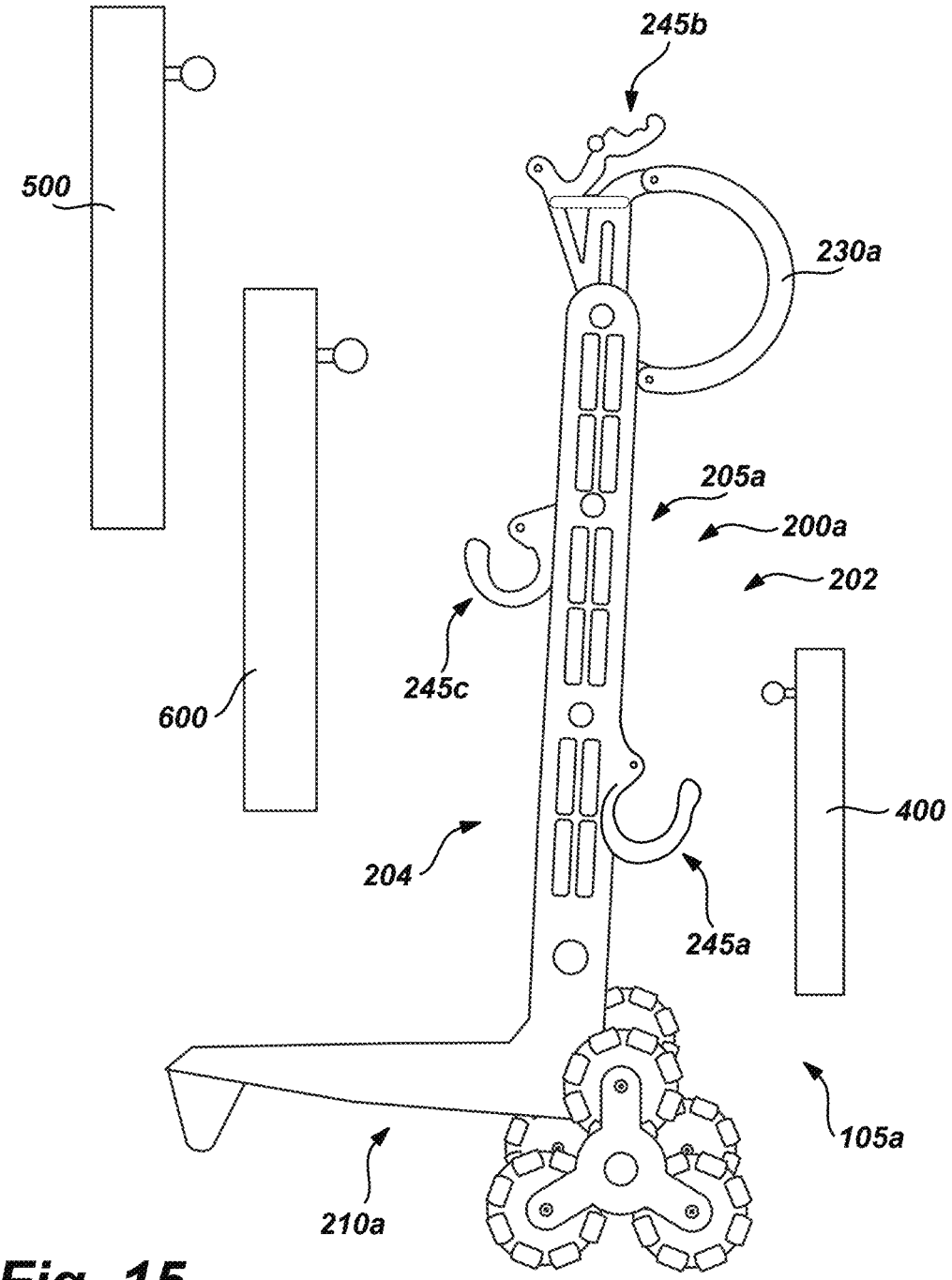
FIG. 15 is a perspective, side view of another exemplary embodiment of the present invention.
Figure 17:
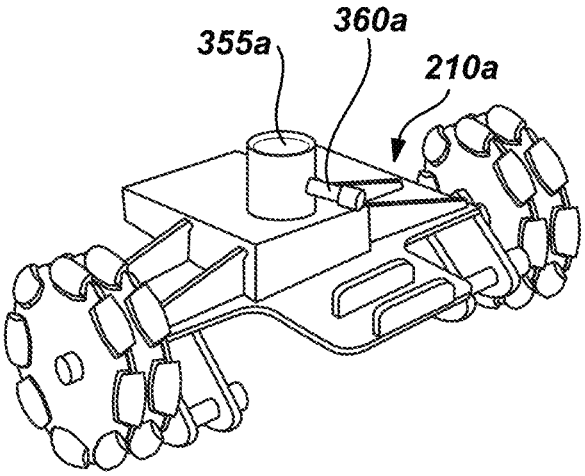
FIG. 17 is a detailed, perspective view of the exemplary embodiment illustrated in FIGS. 15 and 16.
Figure 16:
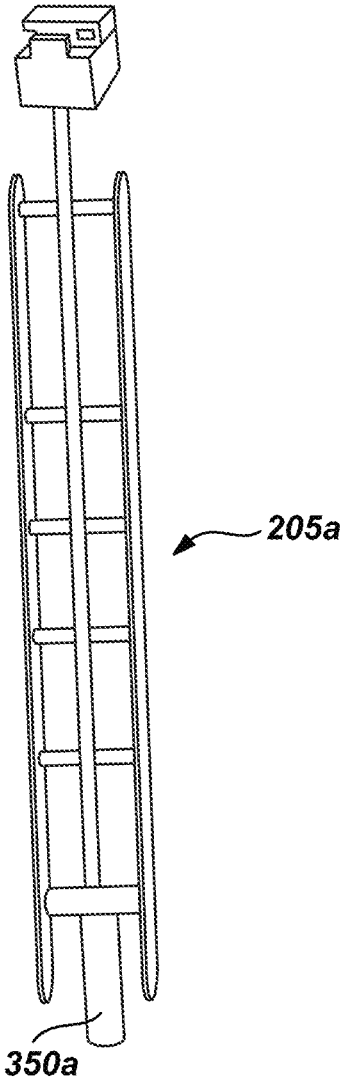
FIG. 16 is another perspective, side view of the exemplary embodiment illustrated in FIG. 15.
Figure 16:
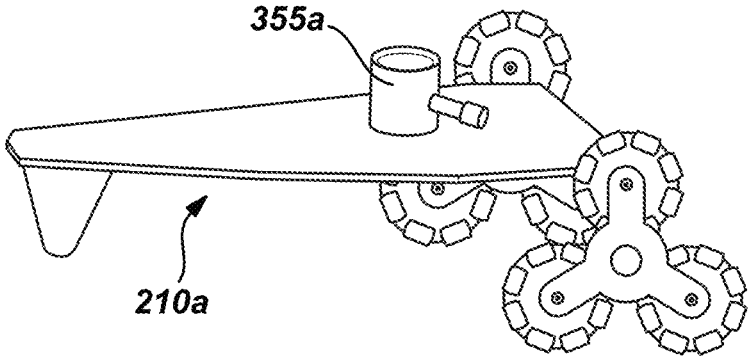

FIGS. 15 through 17 illustrate another exemplary embodiment of the exemplary disclosed barrier apparatus. Barrier apparatus 105*a* may be generally similar to barrier apparatus 105, including for example a structural frame 200*a* that may be generally similar to structural frame 200, first shield assembly 400, second shield assembly 500, and third shield assembly 600. Structural frame 200*a* may include a post assembly 205*a* that may be generally similar to post assembly 205, and a base assembly 210*a* that may be generally similar to base assembly 210. Post assembly 205*a* may include a post handle 230*a* that may be generally similar to post handle 230 (e.g., but may be of a different shape such as, for example, curved, annular, hooked, or any other suitable shape). Structural frame 200*a* may include a first shield holder 245*a*, a second shield holder 245*b* and a third shield holder 245*c*, each of which for example may be similar to shield holder 245. First shield assembly 400 may be removably attachable to first shield holder 245*a*, second shield assembly 500 may be removably attachable to second shield holder 245*b*, and third shield assembly 600 may be removably attachable to third shield holder 245*c* (e.g., similar to as described above regarding shield holder 245). In at least some exemplary embodiments (e.g., when the exemplary disclosed shields are attached to structural frame 200*a* and are to be utilized separately from structural frame 200*a*), second shield assembly 500 may be detached from second shield holder 245*b*, and then third shield assembly 600 may be detached from third shield holder 245*c*.

Post assembly 205*a* may be removably attachable to base assembly 210*a* via any suitable attachment technique. For example as illustrated in FIGS. 16 and 17, post assembly 205*a* may include a post connector 350*a* that may be removably attached to a base connector 355*a* of base assembly 210*a*. In at least some exemplary embodiments, post connector 350*a* may have a tube or cylindrical shape and may be sized to be received in base connector 355*a* that may have a similar and slightly larger shape (e.g., or smaller shape) than post connector 350*a*. Post connector 350*a* and base connector 355*a* may also include apertures that may be aligned when post connector 350*a* and base connector 355*a* are connected and through which an attachment connector 360*a* may be removably received (e.g., to fasten post connector 350*a* to base connector 355*a*). Attachment connector 360*a* may be a pin or other suitable removably attachable fastener.

The exemplary disclosed system, apparatus, and method may be used in any suitable application for shielding individuals such as, for example, against ballistic threats. The exemplary disclosed system, apparatus, and method may be used in any suitable application involving a movable shield. The exemplary disclosed system, apparatus, and method may be used in any suitable application for providing a shield (e.g., barrier) against ballistic projectiles such as from firearms. For example, the exemplary disclosed system, apparatus, and method may be used in any suitable application involving firearm protection and/or body armor.

Figure 18:
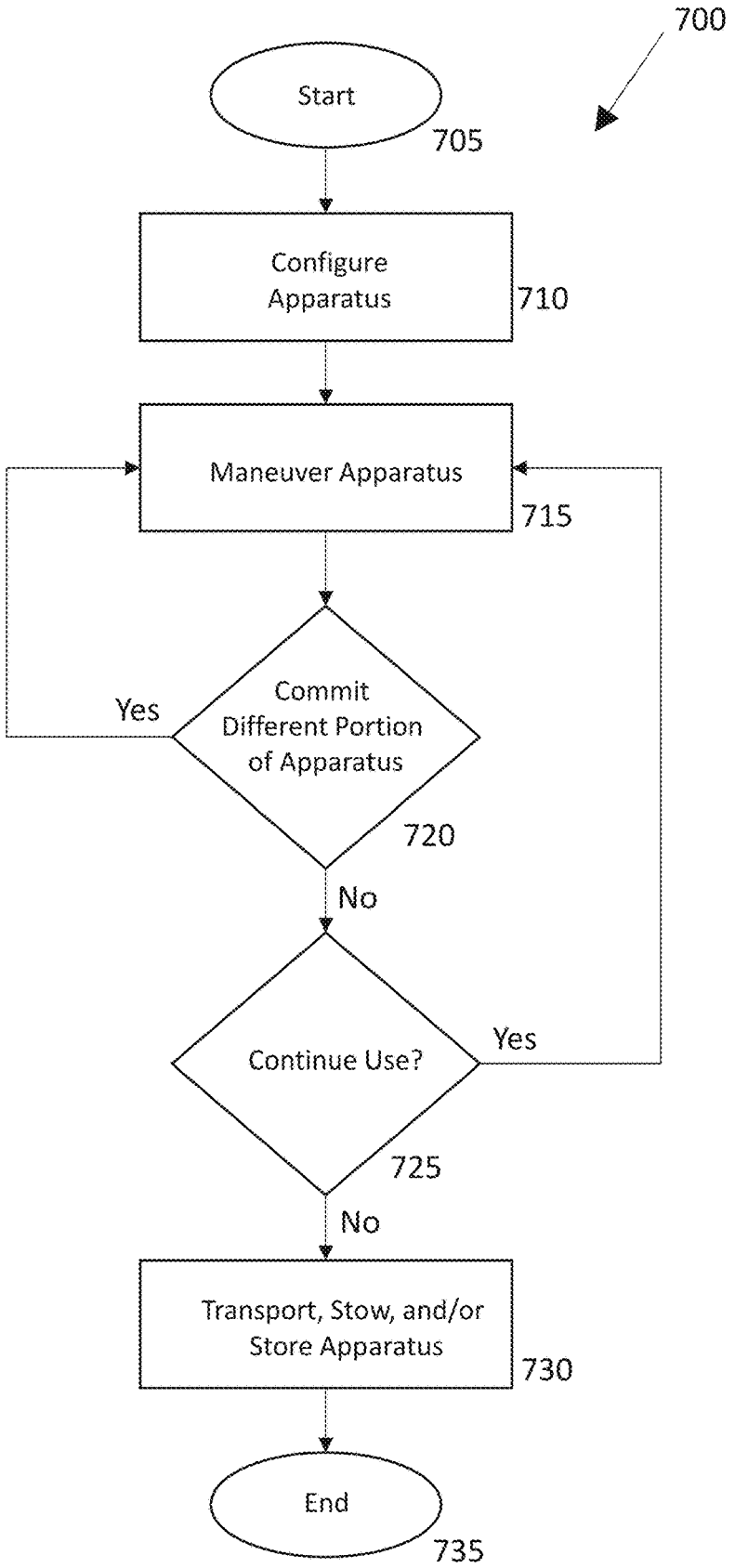
FIG. 18 illustrates an exemplary process of using at least some exemplary embodiments of the present disclosure.

FIG. 18 illustrates an exemplary process of using the exemplary disclosed system and apparatus. Although barrier apparatus 105 will be referred to in describing process 700, barrier apparatus 105*a* may be similarly utilized according to process 700. Process 700 begins at step 705. At step 710, system 100 may be configured. Prior to configuration, when system 100 has been disassembled for transport, stowing, and/or storage, post assembly 205 may be detached from base assembly 210, with post assembly 205 being in the exemplary disclosed retracted position for example as illustrated in FIGS. 11 and 12. First shield assembly 400, second shield assembly 500, and third shield assembly 600 may be detached from structural frame 200 for transport, stowing, and/or storage.

One or more users 150 may configure barrier apparatus 105 by removably attaching post assembly 205 and base assembly 210 for example as described above regarding FIGS. 11 through 14 (e.g., via attachment of one or more attachment protrusions 320 to one or more attachment recesses 325). Also for example, attachment may be made as described above regarding FIGS. 16 and 17 (e.g., via attachment of post connector 350*a* and base connector 355*a*). Post assembly 205 may be moved from the exemplary disclosed retracted position (e.g., as illustrated in FIGS. 11 and 12) to the exemplary disclosed extended position (e.g., as illustrated in FIG. 9) based on operation of movable fasteners 255. Third shield assembly 600 may be removably attached to second side 204 (e.g., front side) of structural frame 200 (e.g., the exemplary disclosed shield handle of third shield assembly 600 may be removably attachable to shield holder 245 or third shield holder 245*c*). Second shield assembly 500 may be removably attached to second side 204 (e.g., front side) of structural frame 200 (e.g., the exemplary disclosed shield handle of second shield assembly 500 may be removably attachable to shield holder 245 or second shield holder 245*b*). A lower portion of second shield assembly 500 may be inserted behind an upper portion of third shield assembly 600 for example as illustrated in FIG. 2. First shield assembly 400 may be removably attached to first side 202 (e.g., rear side) of structural frame 200 (e.g., the exemplary disclosed shield handle of first shield assembly 400 may be removably attachable to shield holder 245 or first shield holder 245*a*). The exemplary disclosed shield holders (e.g., shield holder 245, shield holder 245*a*, shield holder 245*b*, and/or shield holder 245*c*) may be fastened to (e.g., clamped around) the exemplary disclosed shield handles for example using removably attachable fasteners 250 as described above. Any desired items may be attached to the exemplary disclosed attachment layer (e.g., attachment layer 510) for example as described above.

At step 715, one or more users may utilize and maneuver barrier apparatus 105 for example as illustrated in FIGS. 3 and 4. Movement of barrier apparatus 105 may be facilitated by rotation of side wheel assemblies 270 in second rotation direction R2 and third rotation direction R3 (e.g., as illustrated in FIGS. 10A and 13). For example, one or more users 150 may be protected by barrier apparatus 105 from threats such as projectiles (e.g., bullets and/or fragmentation) fired from threat weapon 160 for example as illustrated in FIG. 3. One or more users 150 may detach first shield assembly 400 from structural frame 200 and use first shield assembly 400 separately from the rest of barrier apparatus 105 for example as illustrated in FIG. 4. One or more users 150 may similarly detach second shield assembly 500 (e.g., and third shield assembly 600) and use the one or more exemplary disclosed shields separately from the rest of barrier apparatus 105. The exemplary disclosed shields may be detached and attached to structural frame 200 as suitable for a given operation. Barrier apparatus 105 may thereby provide a versatile, modular defensive system for protecting one or more users 150 from threats such as threat weapons 160.

Barrier apparatus 105 may be moved over uneven surfaces such as stairs and/or difficult terrain. For example as illustrated in FIG. 10A, barrier apparatus 105 may be moved over uneven or difficult terrain (e.g., up stairs). Barrier apparatus 105 may be rotated (e.g., based on user 150 pulling back on post handle 230) so that front wheel assembly 265 may be lifted off of (e.g., tilted or rotated away from) a support surface (e.g., steps) as barrier apparatus 105 is moved. Side wheel assembly 270 may rotate in first rotation direction R1 so that side wheels 295 of different side axles 310 may contact differing portions of the uneven surface as barrier apparatus 105 is moved. For example, a first set of side wheels 295 of a first side axle 310 may contact a side of a first step while a second set of side wheels 295 of a second side axle 310 may contact a top of the first step. Side wheel assembly 270 may rotate, with barrier apparatus 105 supported on the second set of side wheels 295 of second side axle 310, until a third set of side wheels 295 of a third side axle 310 contacts a side surface or a top surface of a second (e.g., next) step. For example, side wheel assembly 270 may rotate based on side wheels 295 of the plurality of side axles 310 contacting riser surfaces (e.g., vertical surfaces) and tread surfaces (e.g., horizontal surfaces) of steps (e.g., as illustrated in FIG. 10A, for example when barrier apparatus 105 is moving up or down stairs). This procedure may continue with barrier apparatus 105 climbing for example up or down stairs as the various sets of side wheels 295 of one or more side wheel assemblies 270 contact additional steps as described above.

At step 720, one or more users 150 may determine whether or not to commit different portions (e.g., detach or reattach different ones of the exemplary disclosed shields) of barrier apparatus 105. If a different portion of barrier apparatus 105 is to be used (e.g., committed), process 700 returns to step 715 so that differing combinations of exemplary disclosed shields may be detached from and reattached to structural frame 200. If a different portion of barrier apparatus 105 is not to be committed, process 700 proceeds to step 725.

At step 725, it may be determined whether use of system 100 is to be continued. If use is to be continued, process 700 returns to step 715. As many iterations as desired of steps 715 through 725 may be performed. If use is not to be continued, process 700 proceeds to step 730.

At step 730, system 100 may be transported, stowed, and/or stored. Any desired items may be detached from the exemplary disclosed attachment layer (e.g., attachment layer 510) of one or more of the exemplary disclosed shield assemblies. If barrier apparatus 105 is fully assembled, first shield assembly 400 may be detached from first side 202 (e.g., rear side) of structural frame 200 (e.g., the exemplary disclosed shield handle of first shield assembly 400 may be detached from shield holder 245 or first shield holder 245*a*). Second shield assembly 500 may be detached from second side 204 (e.g., front side) of structural frame 200 (e.g., the exemplary disclosed shield handle of second shield assembly 500 may be detached from shield holder 245 or second shield holder 245*b*). Third shield assembly 600 may be detached from second side 204 (e.g., front side) of structural frame 200 (e.g., the exemplary disclosed shield handle of third shield assembly 600 may be detached from shield holder 245 or third shield holder 245*c*). Post assembly 205 may be moved from the exemplary disclosed extended position (e.g., as illustrated in FIG. 9) to the exemplary disclosed retracted position (e.g., as illustrated in FIGS. 11 and 12) based on operation of movable fasteners 255. Post assembly 205 and base assembly 210 may be detached from each other based on operation of the exemplary disclosed fasteners described above. If barrier apparatus 105 was already partially disassembled before step 730, any remaining portions of the exemplary disclosed disassembly described above may be performed. The separate components of barrier apparatus 105 may then be relatively easily transported, stowed, and/or stored. Process 700 ends at step 735.

In at least some exemplary embodiments, the exemplary disclosed system and apparatus may be collapsible. The movable assembly may provide for clamping of shields (e.g., ballistic shields) to the assembly. The exemplary disclosed system, apparatus, and method may provide for efficient shield mobility and deployment. The exemplary disclosed assembly may be lightweight (e.g., between about 40 lbs and about 150 lbs) and may have a collapsible design that allows for efficient transport and stowage (e.g., in the trunk of a vehicle). The exemplary disclosed assembly may include multidirectional wheels (e.g., including stair-climber wheels) for traversing difficult terrain such as urbanized (e.g., steps and/or curbsides) or rugged terrain. The assembly may include a single front wheel (e.g., or a plurality of front wheels) and kick plate to allow for relatively easy movement (e.g., easy climbs) over obstacles, curbs, stairs, and/or other features. The exemplary disclosed assembly may hold any suitable shields such as, for example, the exemplary disclosed shields that may be ACI Eagle Level IV and/or Minotaur Level III/III+ shields. The exemplary disclosed assembly may allow for relatively rapid build-up or tear-down (e.g., in less than 30 seconds). The exemplary disclosed assembly may be formed from any suitable material such as, for example, structural steel (e.g., stainless steel). The assembly may include a structural frame that may be formed from steel or any other suitable structural material.

The invention includes other illustrative embodiments ("Embodiments") as follows.

Embodiment 1: An apparatus for supporting a first ballistic shield and a second ballistic shield, comprising: a structural frame; and a wheel assembly rotatably attached to a structural connector of a base assembly of the structural frame; wherein the structural frame is configured to removably attach to the first ballistic shield; wherein the structural frame is configured to removably attach to the second ballistic shield; and wherein the wheel assembly includes a plurality of axles spaced away from the structural connector and configured to rotate about the structural connector when the wheel assembly rotates.

Embodiment 2: The apparatus of Embodiment 1, wherein the plurality of axles evenly spaced about the structural connector, each of the plurality of axles including at least one wheel.

Embodiment 3: The apparatus of Embodiment 1, wherein the plurality of axles includes three axles evenly spaced about the structural connector, each of the three axles including at least one wheel.

Embodiment 4: The apparatus of Embodiment 1, further comprising: a front wheel assembly rotatably attached to a front structural connector of the base assembly; and a side wheel assembly rotatably attached to a second structural connector of the base assembly; wherein the side wheel assembly is disposed at an opposite side of the base assembly as the wheel assembly.

Embodiment 5: The apparatus of Embodiment 1, wherein the structural connector is rotatable in a direction perpendicular to the rotation of the wheel assembly.

Embodiment 6: The apparatus of Embodiment 1, wherein the first ballistic shield and the second ballistic shield are each handheld ballistic shields.

Embodiment 7: The apparatus of Embodiment 1, wherein the structural frame is configured to removably attach to a third ballistic shield; wherein: the first ballistic shield is disposed at a first side of the structural frame; and the second and third ballistic shields are disposed at a second side of the structural frame that is an opposite side as the first side.

Embodiment 8: The apparatus of Embodiment 1, wherein the structural frame further includes a post assembly that is removably attachable to the base assembly, the first and second ballistic shields being removably attachable to the post assembly.

Embodiment 9: The apparatus of Embodiment 1, wherein the structural frame further includes a post assembly that is removably attachable to the base assembly, the post assembly being extendable and retractable between a retracted position and an extended position.

Embodiment 10: The apparatus of Embodiment 1, wherein at least one of the first and second ballistic shields includes at least one attachment layer configured to fasten one or more items to the at least one of the first and second ballistic shields.

Embodiment 11: A method, comprising: providing a structural frame having a wheel assembly rotatably attached to a structural connector of a base assembly of the structural frame, the wheel assembly including a plurality of axles spaced away from the structural connector; removably attaching a first ballistic shield to the structural frame; removably attaching a second ballistic shield to the structural frame; and moving the structural frame and rotating the plurality of axles about the structural connector as the wheel assembly rotates along an uneven surface, each of the plurality of axles including at least one wheel.

Embodiment 12: The method of Embodiment 11, further comprising moving the structural frame up or down stairs, the wheel assembly rotating based on the wheels of the plurality of axles contacting riser surfaces and tread surfaces of the stairs.

Embodiment 13: The method of Embodiment 11, further comprising detaching and using one of the first and second ballistic shields separately from the other of the first and second ballistic shields that is removably attached to the structural frame.

Embodiment 14: The method of Embodiment 11, further comprising removably attaching a post assembly of the structural frame to the base assembly, the first and second ballistic shields being removably attachable to the post assembly.

Embodiment 15: The method of Embodiment 11, further comprising: removably attaching a post assembly of the structural frame to the base assembly; and extending and retracting the post assembly between a retracted position and an extended position.

Embodiment 16: An apparatus, comprising: a structural frame including a base assembly and a post assembly; a plurality of wheel assemblies rotatably attached to the base assembly; a first ballistic shield removably attachable to the post assembly; a second ballistic shield removably attachable to the post assembly; and a third ballistic shield removably attachable to the post assembly; wherein the post assembly is removably attachable to the base assembly; and wherein the post assembly is extendable and retractable between a retracted position and an extended position.

Embodiment 17: The apparatus of Embodiment 16, wherein the plurality of wheel assemblies includes a plurality of side wheel assemblies, each side wheel assembly including a plurality of axles spaced away from a structural connector attaching each side wheel assembly to the base assembly and configured to rotate about the structural connector when each side wheel assembly rotates.

Embodiment 18: The apparatus of Embodiment 17, wherein the plurality of wheel assemblies includes a front wheel assembly rotatably attached to a front structural connector of the base assembly.

Embodiment 19: The apparatus of Embodiment 16, wherein: the first ballistic shield is disposed at a first side of the structural frame; and the second and third ballistic shields are disposed at a second side of the structural frame that is an opposite side as the first side.

Embodiment 20: The apparatus of Embodiment 16, wherein each of the first, second, and third second ballistic shields is a handheld shield including at least one attachment layer configured to fasten one or more items to each of the first, second, and third second ballistic shields.

In at least some exemplary embodiments, the exemplary disclosed system, apparatus, and method may provide an efficient and effective system for providing a movable shield that may be easily moved by a single individual. The exemplary disclosed system, apparatus, and method may provide a movable shield that may be easily moved over difficult terrain. For example, the exemplary disclosed system, apparatus, and method may provide a movable shield that may be efficiently and effectively moved up and down stairs. The exemplary disclosed system, apparatus, and method may provide a movable shield that may be relatively lightweight while offering a relatively high body armor class type.

It will be apparent to those skilled in the art that various modifications and variations can be made to the exemplary disclosed system, apparatus, and method. Other embodiments will be apparent to those skilled in the art from consideration of the specification and practice of the exemplary disclosed apparatus, system, and method. It is intended that the specification and examples be considered as exemplary, with a true scope being indicated by the following claims.

What is claimed is:

1. An apparatus for supporting a first ballistic shield and a second ballistic shield, comprising:

a structural frame; and a wheel assembly rotatably attached to a structural connector of a base assembly of the structural frame;

wherein the structural frame is configured to removably attach to the first ballistic shield;

wherein the structural frame is configured to removably attach to the second ballistic shield; and wherein the wheel assembly includes a plurality of axles spaced away from the structural connector and configured to rotate about the structural connector when the wheel assembly rotates.

2. The apparatus of claim 1, wherein the plurality of axles evenly spaced about the structural connector, each of the plurality of axles including at least one wheel.

3. The apparatus of claim 1, wherein the plurality of axles includes three axles evenly spaced about the structural connector, each of the three axles including at least one wheel.

4. The apparatus of claim 1, further comprising:

a front wheel assembly rotatably attached to a front structural connector of the base assembly; and a side wheel assembly rotatably attached to a second structural connector of the base assembly;

wherein the side wheel assembly is disposed at an opposite side of the base assembly as the wheel assembly.

5. The apparatus of claim 1, wherein the structural connector is rotatable in a direction perpendicular to the rotation of the wheel assembly.

6. The apparatus of claim 1, wherein the first ballistic shield and the second ballistic shield are each handheld ballistic shields.

7. The apparatus of claim 1, wherein the structural frame is configured to removably attach to a third ballistic shield; wherein:

the first ballistic shield is disposed at a first side of the structural frame; and the second and third ballistic shields are disposed at a second side of the structural frame that is an opposite side as the first side.

8. The apparatus of claim 1, wherein the structural frame further includes a post assembly that is removably attachable to the base assembly, the first and second ballistic shields being removably attachable to the post assembly.

9. The apparatus of claim 1, wherein the structural frame further includes a post assembly that is removably attachable to the base assembly, the post assembly being extendable and retractable between a retracted position and an extended position.

10. The apparatus of claim 1, wherein at least one of the first and second ballistic shields includes at least one attachment layer configured to fasten one or more items to the at least one of the first and second ballistic shields.

11. A method, comprising:

providing a structural frame having a wheel assembly rotatably attached to a structural connector of a base assembly of the structural frame, the wheel assembly including a plurality of axles spaced away from the structural connector;

removably attaching a first ballistic shield to the structural frame;

removably attaching a second ballistic shield to the structural frame; and moving the structural frame and rotating the plurality of axles about the structural connector as the wheel assembly rotates along an uneven surface, each of the plurality of axles including at least one wheel.

12. The method of claim 11, further comprising moving the structural frame up or down stairs, the wheel assembly rotating based on the wheels of the plurality of axles contacting riser surfaces and tread surfaces of the stairs.

13. The method of claim 11, further comprising detaching and using one of the first and second ballistic shields separately from the other of the first and second ballistic shields that is removably attached to the structural frame.

14. The method of claim 11, further comprising removably attaching a post assembly of the structural frame to the base assembly, the first and second ballistic shields being removably attachable to the post assembly.

15. The method of claim 11, further comprising:

removably attaching a post assembly of the structural frame to the base assembly; and extending and retracting the post assembly between a retracted position and an extended position.

16. An apparatus, comprising:

a structural frame including a base assembly and a post assembly;

a plurality of wheel assemblies rotatably attached to the base assembly;

a first ballistic shield removably attachable to the post assembly;

a second ballistic shield removably attachable to the post assembly; and a third ballistic shield removably attachable to the post assembly;

wherein the post assembly is removably attachable to the base assembly; and wherein the post assembly is extendable and retractable between a retracted position and an extended position.

17. The apparatus of claim 16, wherein the plurality of wheel assemblies includes a plurality of side wheel assemblies, each side wheel assembly including a plurality of axles spaced away from a structural connector attaching each side wheel assembly to the base assembly and configured to rotate about the structural connector when each side wheel assembly rotates.

18. The apparatus of claim 17, wherein the plurality of wheel assemblies includes a front wheel assembly rotatably attached to a front structural connector of the base assembly.

19. The apparatus of claim 16, wherein:

the first ballistic shield is disposed at a first side of the structural frame; and the second and third ballistic shields are disposed at a second side of the structural frame that is an opposite side as the first side.

20. The apparatus of claim 16, wherein each of the first, second, and third second ballistic shields is a handheld shield including at least one attachment layer configured to fasten one or more items to each of the first, second, and third second ballistic shields.

* * * * *